US010249465B2

(12) United States Patent
Brakefield et al.

(10) Patent No.: US 10,249,465 B2
(45) Date of Patent: Apr. 2, 2019

(54) FUSE HOLDER, CARRIER AND ASSOCIATED METHOD

(71) Applicant: Regal Beloit America, Inc., Beloit, WI (US)

(72) Inventors: Timothy Joseph Brakefield, Perrysburg, OH (US); Troy Thomas Minnick, Oregon, OH (US); Isaac Phillip Shaffer, Cygnet, OH (US); Paul Scott Buskey, Waterville, OH (US)

(73) Assignee: Regal Beloit America, Inc., Beloit, WI (US)

( * ) Notice: Subject to any disclaimer, the term of this patent is extended or adjusted under 35 U.S.C. 154(b) by 212 days.

(21) Appl. No.: 15/182,717

(22) Filed: Jun. 15, 2016

(65) Prior Publication Data

US 2017/0365436 A1 Dec. 21, 2017

(51) Int. Cl.

| | |
|---|---|
| ***H01H 85/22*** | (2006.01) |
| ***H01H 85/175*** | (2006.01) |
| ***H01H 21/22*** | (2006.01) |
| ***H01H 89/04*** | (2006.01) |
| ***H01H 85/20*** | (2006.01) |

(52) U.S. Cl.

CPC ..... *H01H 85/22* (2013.01); *H01H 85/205* (2013.01); *H01H 89/04* (2013.01)

(58) Field of Classification Search

CPC ..... H01H 85/22; H01H 85/175; H01H 21/22; H01H 89/04

USPC ..... 337/12, 168

See application file for complete search history.

(56) References Cited

U.S. PATENT DOCUMENTS

| | | | | |
|---|---|---|---|---|
| 3,614,697 | A * | 10/1971 | Dunham | H01H 9/10 337/6 |
| 3,958,197 | A * | 5/1976 | Gryctko | H01H 83/22 335/18 |
| 3,958,204 | A * | 5/1976 | Gryctko | H01H 71/121 335/18 |
| 6,717,505 | B1 * | 4/2004 | Bruchmann | H01H 85/32 337/187 |
| 7,474,194 | B2 | 1/2009 | Darr et al. | |
| 7,495,540 | B2 | 2/2009 | Darr et al. | |
| 7,561,017 | B2 | 7/2009 | Darr et al. | |
| 7,576,630 | B2 | 8/2009 | Darr | |
| 7,855,630 | B2 | 12/2010 | Darr et al. | |
| 7,855,873 | B2 | 12/2010 | Darr et al. | |
| 7,924,136 | B2 | 4/2011 | Darr et al. | |
| 8,089,335 | B2 | 1/2012 | Darr et al. | |

(Continued)

*Primary Examiner* — Anatoly Vortman

(74) *Attorney, Agent, or Firm* — John Wagley

(57) ABSTRACT

A fuse holder for holding a fuse is provided that includes a body, a line side connector supported by the body, and a load side connector supported by the body. The fuse holder also includes a toggle switch supported by the body and capable of toggled engagement in a first position that provides electrical connection. The switch is also capable of toggled engagement in a second position that provides electrical isolation between the line side connector and the load side connector. The fuse holder also includes a fuse carrier. The fuse carrier is supported by the body and adapted for holding the fuse and the fuse carrier is adapted to be removed from the fuse holder. The fuse holder includes a blocking device blocking the toggled engagement of the switch from the second position to the first position when the fuse carrier is not within the fuse holder.

20 Claims, 12 Drawing Sheets

(56) References Cited

U.S. PATENT DOCUMENTS

| | | | | |
|---|---|---|---|---|
| 8,310,333 | B2 | 11/2012 | Ventura et al. | |
| 8,344,844 | B2 | 1/2013 | Darr | |
| 8,614,618 | B2 | 12/2013 | Darr et al. | |
| 8,854,174 | B2 | 10/2014 | Su et al. | |
| 8,988,183 | B2 | 3/2015 | Darr et al. | |
| 9,136,083 | B2 * | 9/2015 | Brakefield | H01R 13/648 |
| 9,224,548 | B2 | 12/2015 | Dunker | |
| 9,613,776 | B2 * | 4/2017 | Brakefield | H01H 85/143 |
| 2006/0125596 | A1 * | 6/2006 | Darr | H01H 9/104 337/194 |
| 2011/0193675 | A1 * | 8/2011 | Darr | H01H 1/20 337/187 |
| 2013/0015940 | A1 * | 1/2013 | Dunker | H01H 9/104 337/12 |

* cited by examiner

FUSE HOLDER, CARRIER AND ASSOCIATED METHOD

CROSS-REFERENCE TO RELATED APPLICATIONS

Cross reference is made to the following application 16-BG-002-UPA1 Titled "FUSE HOLDER AND CARRIER" filed on Jun. 15, 2016 and filed concurrently herewith which is incorporated herein by reference in its entirety.

BACKGROUND OF THE INVENTION

The field of the invention relates generally to electrical transmission equipment and more specifically to a fuse holder for use in electrical circuits for example those circuits used in electrical transmission equipment.

Fuses are regularly used in electrical circuits to provide protection for electrical components from electrical overloads. Fuses are for example used in electrical transmission equipment to provide protection for electrical components from electrical surges originating from the power line or from excessive electrical loads. Replaceable fuses are often used. These replaceable fuses are often placed in electrical or fuse boxes. The electrical or fuse boxes may be located where they are not easily accessed and may be mounted in any orientation where space permits.

These replaceable fuses are consumed and provide an open circuit when exposed to a sufficient overload. Such replaceable fuses need to be replaced once consumed. Access to such replaceable fuses in electrical or fuse boxes is often difficult, particularly when the fuse box is located in a poorly accessible location.

The fuse may need to be safely replaced without disenabling the power in the line. Once removed, it may be discovered that a replacement fuse is not available which may necessitate that access to a hot power line may need to be prevented when the fuse is not in the holder.

Some fuses are quite large and need to be inserted easily and safely into the fuse box, while not contacting the hot power line. The fuse boxes for these large fuses may accommodate may fuses and are inherently large. Minimizing the size of these fuse boxes may result in making access to the fuses more difficult, as sufficient space between adjacent fuses for accommodation for access by hands into the box may be compromised.

The present invention is directed toward alleviating at least some of the above mentioned difficulties with the prior art.

BRIEF DESCRIPTION OF THE INVENTION

According to an embodiment of the invention, a fuse holder for holding a fuse is provided. The fuse holder includes a body, a line side connector supported by the body, and a load side connector supported by the body.

The fuse holder also includes a toggle switch supported by the body. The switch is capable of toggled engagement in a first position that provides electrical connection between the line side connector and the load side connector. The switch is also capable of toggled engagement in a second position that provides electrical isolation between the line side connector and the load side connector.

The fuse holder also includes a fuse carrier. The fuse carrier is supported by the body. The fuse carrier is adapted for holding the fuse and the fuse carrier is adapted to be removed from the fuse holder The fuse holder also includes a blocking device for blocking the toggled engagement of the switch from the second position to the first position when the fuse carrier is not located within the fuse holder.

According to an aspect of the present invention, the blocking device may be adapted to urge the switch from toggled engagement in the first position to toggled engagement in the second position as the fuse carrier is removed from the fuse holder.

According to another aspect of the present invention, the fuse holder may be provided wherein the fuse carrier defines a longitudinal axis and wherein the fuse carrier is separable from the body in a direction along the longitudinal axis of the fuse holder.

According to another aspect of the present invention, the fuse holder may be provided wherein the switch includes the first portion that pivots from a first position providing electrical connection between the line side connector and the load side connector to the second position providing electrical isolation between the line side connector and the load side connector and wherein the switch includes a second portion that includes a pair of switch contacts that selectably engage and disengage with a pair of body contacts fixedly secured to the body. The second portion is slidably movable with respect to the body. The second portion is operably connected to the first portion.

According to another aspect of the present invention, the fuse holder may be provided wherein the blocking device is pivotally mounted in the body.

According to another aspect of the present invention, the fuse holder may be provided wherein the fuse carrier defines a longitudinal axis. The fuse being separable from said fuse carrier in a direction normal to the longitudinal axis of said fuse carrier.

According to another aspect of the present invention, the fuse holder may further include a first electrical contact for electrical connection with a first end of the fuse and the fuse holder may further include a second electrical contact for electrical connection with a second end of the fuse, opposed to the first end of the fuse. The fuse holder may be adapted to provide for toggled engagement of the switch in the second position prior to the electrical disengagement of at least one of first end of the fuse to the first electrical contact and second end of the fuse to the second electrical contact as the fuse carrier is removed from the fuse holder.

According to another aspect of the present invention, the fuse holder may be provided wherein the blocking device has a first position for blocking the removal of the fuse carrier from the body when the switch is in toggled engagement in the first position and wherein the blocking device has a second position for permitting the removal of the fuse carrier from the body when the switch is in toggled engagement in the second position According to another aspect of the present invention, the fuse holder may be provided wherein the blocking device includes a blocking device feature and wherein the fuse holder includes a fuse holder feature for cooperation with the blocking device feature for blocking the removal of the fuse carrier from the body when the switch is in the first position.

According to another aspect of the present invention, the fuse holder may be provided wherein the blocking device feature or the fuse holder feature includes a protrusion and wherein the other of the blocking device feature and the fuse holder feature includes a void.

According to another aspect of the present invention, the fuse holder may be provided wherein the fuse holder further includes fuse electrical contacts mounted to the body. The contacts have concave engagement surfaces adapted to engage opposed cylindrical electrical contacts of the fuse.

According to another aspect of the present invention, the fuse holder may be provided wherein the fuse holder further includes an indicating module for indicating that a fuse is not functioning properly.

According to another embodiment of the invention, a fuse holder for holding a fuse is provided. The fuse holder includes a body, a line side connector supported by the body, and a load side connector supported by the body.

The fuse holder also includes a toggle switch supported by the body. The switch is capable of toggled engagement in a first position providing electrical connection between the line side connector and the load side connector. The switch is capable of toggled engagement in a second position providing electrical isolation between the line side connector and the load side connector.

The fuse holder also includes a fuse carrier supported by the body. The fuse carrier is adapted to hold the fuse and the fuse carrier is adapted to be removed from the fuse holder.

The fuse holder also includes a blocking device for blocking the toggled engagement of the switch into the first position when the fuse carrier is not located within the fuse holder. The blocking device may be positioned between the toggle switch and the fuse carrier.

According to another aspect of the present invention, the fuse holder may be provided wherein the blocking device is adapted to urge the switch from toggled engagement in the first position to toggled engagement in the second position as the fuse carrier is removed from the fuse holder.

According to another aspect of the present invention, the fuse holder may be provided wherein the fuse carrier defines a longitudinal axis and wherein the fuse carrier is separable from the body in a direction along the longitudinal axis of the fuse carrier.

According to another aspect of the present invention, the fuse holder may be provided wherein the switch includes a first portion that pivots from the first position providing electrical connection between the line side connector and the load side connector to the second position providing electrical isolation between the line side connector and the load side connector and wherein the switch includes a second portion that includes a pair of switch contacts that may be selected to engage and disengage with a pair of body contacts fixedly secured to the body, the second portion slides with respect to the body, the second portion operably connected to the first portion.

According to another aspect of the present invention, the fuse holder may be provided wherein the blocking device is pivotally mounted in the body.

According to another aspect of the present invention, the fuse holder may be provided wherein the line side connector includes an electrical contact for electrical connection with a first end of the fuse and wherein the load side connector includes an electrical contact for electrical connection with a second end of the fuse. The second end is opposed to the first end of the fuse. Further, the fuse holder is adapted to provide for toggled engagement of the switch in the second position prior to the electrical disengagement of at least one of first end of the fuse to the line side connector and second end of the fuse to the load side connector as the fuse carrier is removed from the fuse holder.

According to another aspect of the present invention, the fuse holder may be provided wherein the blocking device has a first position for blocking the removal of the fuse carrier from the body when the switch is toggled engagement in the first position and wherein the blocking device has a second position for permitting the removal of the fuse carrier from the body when the switch is in toggled engagement in the second position.

According to another aspect of the present invention, the fuse holder may be provided wherein the blocking device includes a blocking device feature and wherein the fuse holder includes a fuse holder feature for cooperation with the blocking device feature for blocking the removal of the fuse carrier from the body when the switch is in toggled engagement in the first position.

According to another aspect of the present invention, the fuse holder may be provided wherein the blocking device feature or the fuse holder feature includes a protrusion and the other of the blocking device feature and the fuse holder feature includes a void.

According to another aspect of the present invention, the fuse holder may be provided wherein the fuse holder further includes fuse electrical contacts mounted to the body. The contacts have concave engagement surfaces adapted to engage opposed cylindrical electrical contacts of the fuse.

According to another embodiment of the invention, a method for replacement of a fuse to and from a fuse holder is provided. The method includes the steps of providing a fuse holder, slidably fitting a fuse carrier for holding a fuse in the fuse holder, operably connecting the fuse carrier to a switch having an electrically connected position and an electrically isolated position, and pulling the fuse carrier with a used fuse outwardly from the fuse holder.

The method further includes the steps of automatically tripping the switch to the electrically isolated position as the fuse carrier is removed, removing the used fuse from the fuse holder when the fuse carrier is removed from the fuse holder, inserting a new fuse into the fuse holder when the fuse carrier is removed from the fuse holder, and pushing the fuse carrier with a new fuse inwardly into the fuse holder.

According to another embodiment of the invention, a fuse holder for holding a fuse is provided. The fuse holder includes a body, a line side connector supported by the body, and a load side connector supported by the body.

The fuse holder also includes a fuse carrier supported by the body. The fuse carrier is adapted for holding the fuse and the fuse carrier is adapted to be removed from the fuse holder. The fuse carrier defines a longitudinal axis thereof. The fuse carrier is separable from the body in a direction along the longitudinal axis of the fuse carrier.

According to another aspect of the present invention, the fuse holder may further include a switch supported by the body. The switch includes a first position providing electrical connection between the line side connector and the load side connector and includes a second position providing electrical isolation between the line side connector and the load side connector.

According to another aspect of the present invention, the fuse holder may be provided wherein the switch includes a toggle switch supported by the body. The switch is capable of toggled engagement in the first position providing electrical connection between the line side connector and the load side connector. The switch is further capable of toggled engagement in the second position providing electrical isolation between the line side connector and the load side connector. The fuse holder further includes a blocking device for blocking the toggled engagement of the switch into the first position when the fuse carrier is not located within the fuse holder.

According to another aspect of the present invention, the fuse holder may be provided wherein the blocking device is adapted to urge the switch from toggled engagement in the first position to toggled engagement in the second position as the fuse carrier is removed from the fuse holder.

According to another aspect of the present invention, the fuse holder may be provided wherein the switch includes a first portion that pivots from a first position providing electrical connection between the line side connector and the load side connector to a second position providing electrical isolation between the line side connector and the load side connector and wherein the switch includes a second portion that includes a pair of switch contacts that selectably engage and disengage with a pair of body contacts fixedly secured to the body. The second portion is slidably movable with respect to the body. The second portion operably connected to the first portion.

According to another aspect of the present invention, the fuse holder may be provided wherein the blocking device is pivotally mounted in the body.

According to another aspect of the present invention, the fuse holder may be provided wherein the fuse carrier defines a longitudinal axis. The fuse being separable from said fuse carrier in a direction normal to the longitudinal axis of said fuse carrier.

According to another aspect of the present invention, the fuse holder may further include a first electrical contact for electrical connection with a first end of the fuse and the fuse holder may further include a second electrical contact for electrical connection with a second end of the fuse, opposed to the first end of the fuse. The fuse holder may be adapted to provide for toggled engagement of the switch in the second position prior to the electrical disengagement of at least one of first end of the fuse to the first electrical contact and second end of the fuse to the second electrical contact as the fuse carrier is removed from the fuse holder.

According to another aspect of the present invention, the fuse holder may be provided wherein the blocking device has a first position for blocking the removal of the fuse carrier from the body when the switch is in toggled engagement in the first position and wherein the blocking device has a second position for permitting the removal of the fuse carrier from the body when the switch is in toggled engagement in the second position.

According to another aspect of the present invention, the fuse holder may be provided wherein the blocking device includes a blocking device feature and wherein the fuse holder includes a fuse holder feature for cooperation with the blocking device feature for blocking the removal of the fuse carrier from the body when the switch is in toggled engagement in the first position.

According to another aspect of the present invention, the fuse holder may be provided wherein the blocking device feature or the fuse holder feature includes a protrusion and wherein the other of the blocking device feature and the fuse holder feature includes a void.

According to another aspect of the present invention, the fuse holder may be provided wherein the fuse holder further includes fuse electrical contacts mounted to the body. The contacts have concave engagement surfaces adapted to engage opposed cylindrical electrical contacts of the fuse.

According to another aspect of the present invention, the fuse holder may be provided wherein the fuse carrier further includes an indicating module for indicating that a fuse is not functioning properly.

According to another embodiment of the invention, a fuse holder for holding a fuse is provided. The fuse holder includes a body, a line side connector supported by the body, and a load side connector supported by the body.

The fuse holder further includes a fuse carrier supported by the body. The fuse carrier is adapted for holding the fuse and the fuse carrier is adapted to be removed from the fuse holder. The fuse carrier defines a longitudinal axis. The fuse carrier is separable from the body in a direction along the longitudinal axis of the fuse carrier.

According to another aspect of the present invention, the fuse holder may further include a pivoting switch supported by the body. The switch includes a first position providing electrical connection between the line side connector and the load side connector and a second position providing electrical isolation between the line side connector and the load side connector.

According to another aspect of the present invention, the fuse holder may be provided wherein the switch includes a toggle switch supported by the body. The switch is capable of toggled engagement in a first position providing electrical connection between the line side connector and the load side connector. The switch is capable of toggled engagement in a second position providing electrical isolation between the line side connector and the load side connector. The fuse holder further includes a blocking device for blocking the toggled engagement of the switch into the first position when the fuse carrier is not located within the fuse holder.

According to another aspect of the present invention, the fuse holder may be provided wherein the blocking device is adapted to switch the switch from toggled engagement in the first position to toggled engagement in the second position as the fuse carrier is removed from the fuse holder.

According to another aspect of the present invention, the fuse holder may be provided wherein the switch includes a first portion that pivots from a first position providing electrical connection between the line side connector and the load side connector to a second position providing electrical isolation between the line side connector and the load side connector and wherein the switch includes a second portion that includes a pair of switch contacts that selectably engage and disengage with a pair of body contacts fixedly secured to the body. The second portion is slidably movable with respect to the body. The second portion is operably connected to the first portion.

According to another aspect of the present invention, the fuse holder may be provided wherein the blocking device is pivotally mounted in the body.

According to another aspect of the present invention, the fuse holder may be provided wherein the fuse carrier defines a longitudinal axis. The fuse being separable from said fuse carrier in a direction normal to the longitudinal axis of said fuse carrier.

According to another aspect of the present invention, the fuse holder may be provided wherein the line side connector includes an electrical contact for electrical connection with a first end of the fuse and wherein the load side connector includes an electrical contact for electrical connection with a second end of the fuse. The second end is opposed to the first end of the fuse. Further, the fuse holder is adapted to provide for toggled engagement of the switch in the second position prior to the electrical disengagement of at least one of first end of the fuse to the line side connector and second end of the fuse to the load side connector as the fuse carrier is removed from the fuse holder.

According to another aspect of the present invention, the fuse holder may be provided wherein the blocking device has a first position for blocking the removal of the fuse carrier from the body when the switch is in toggled engagement in the first position and wherein the blocking device has a second position for permitting the removal of the fuse carrier from the body when the switch is in toggled engagement in the second position.

According to another aspect of the present invention, the fuse holder may be provided wherein the blocking device includes a blocking device feature and wherein the fuse holder includes a fuse holder feature for cooperation with the blocking device feature for blocking the removal of the fuse carrier from the body when the switch is in toggled engagement in the first position.

According to another aspect of the present invention, the fuse holder may be provided wherein the blocking device feature or the fuse holder feature includes a protrusion and wherein the other of the blocking device feature and the fuse holder feature includes a void.

According to another aspect of the present invention, the fuse holder may be provided wherein the fuse holder further includes fuse electrical contacts mounted to the body. The contacts having concave engagement surfaces adapted to engage opposed cylindrical electrical contacts of the fuse.

According to another embodiment of the invention, a fuse carrier for use with a fuse holder is provided. The fuse holder has a toggle switch for selectively providing an electrical isolation and an electrical connection between a line side connector and a load side connector. The fuse carrier includes a fuse carrier body defining an opening thereof adapted for receiving the fuse. The fuse carrier body defines a feature for cooperation with the switch for urging the switch from toggled engagement in the first position to toggled engagement in the second position as the fuse carrier is removed from the fuse holder.

According to another embodiment of the invention, a fuse carrier for use with a fuse holder and a blown fuse indicator is provided. The fuse carrier includes a fuse carrier body defining an opening thereof adapted for receiving the fuse. The fuse carrier body further defines a feature adapted to secure the blown fuse indicator to the fuse carrier body.

According to another aspect of the present invention, the fuse carrier may be provided wherein the fuse carrier is further adapted for use in a fuse holder having a toggle switch for selectively providing toggled engagement in a first position providing an electrical connection and toggled engagement in a second position providing an electrical isolation between a line side connector and a load side connector. The fuse carrier body defining a feature for cooperation with the switch for urging the switch into toggled engagement in the first position when the fuse carrier is in position in the fuse holder.

According to another aspect of the present invention, the fuse carrier may be provided wherein the blown fuse indicator is removeably securable to the fuse carrier body.

According to another embodiment of the invention, a fuse holder for holding a fuse is provided. The fuse holder includes a body, a line side connector supported by the body, and a load side connector supported by the body.

The fuse holder also includes a blown fuse indicator for determining whether the fuse is functioning properly or is blown and a fuse carrier supported in the fuse holder.

The fuse carrier is adapted for use with the fuse holder and the blown fuse indicator. The fuse carrier has a fuse carrier body. The fuse carrier body defines an opening of the body that is adapted for receiving the fuse. The fuse carrier body further defines a feature adapted to secure the blown fuse indicator to the fuse carrier.

According to another aspect of the present invention, the fuse holder may further include a switch supported by the body. The switch includes a first position providing electrical connection between the line side connector and the load side connector and includes a second position providing electrical isolation between the line side connector and the load side connector.

According to another aspect of the present invention, the fuse holder may be provided wherein the switch includes a toggle switch supported by the body. The switch is capable of toggled engagement in the first position providing electrical connection between the line side connector and the load side connector. The switch is capable of toggled engagement in the second position providing electrical isolation between the line side connector and the load side connector.

The fuse holder further includes a blocking device for blocking the toggled engagement of the switch into the first position when the fuse carrier is not located within the fuse holder.

According to another aspect of the present invention, the fuse holder may be provided wherein the blocking device is adapted to urge the switch from toggled engagement in the first position to toggled engagement in the second position as the fuse carrier is removed from the fuse holder.

According to another aspect of the present invention, the fuse holder may be provided wherein the switch includes a first portion that pivots from the first position providing electrical connection between the line side connector and the load side connector to the second position providing electrical isolation between the line side connector and the load side connector and wherein the switch includes a second portion that includes a pair of switch contacts that selectably engage and disengage with a pair of body contacts fixedly secured to the body. The second portion is slidably movable with respect to the body. The second portion is operably connected to the first portion.

According to another aspect of the present invention, the fuse holder may be provided wherein the blocking device is pivotally mounted in the body.

According to another aspect of the present invention, the fuse holder may be provided wherein the fuse carrier defines a longitudinal axis. The fuse being separable from said fuse carrier in a direction normal to the longitudinal axis of said fuse carrier.

According to another aspect of the present invention, the fuse holder may further include a first electrical contact for electrical connection with a first end of the fuse and the fuse holder may further include a second electrical contact for electrical connection with a second end of the fuse, opposed to the first end of the fuse. The fuse holder may be adapted to provide for toggled engagement of the switch in the second position prior to the electrical disengagement of at least one of first end of the fuse to the first electrical contact and second end of the fuse to the second electrical contact as the fuse carrier is removed from the fuse holder.

According to another aspect of the present invention, the fuse holder may be provided wherein the blocking device has a first position for blocking the removal of the fuse carrier from the body when the switch is in toggled engagement in the first position and wherein the blocking device has a second position for permitting the removal of the fuse carrier from the body when the switch is in toggled engagement in the second position.

According to another aspect of the present invention, the fuse holder may be provided wherein the blocking device comprises a blocking device feature and wherein the fuse holder comprises a fuse holder feature for cooperation with the blocking device feature for blocking the removal of the fuse carrier from the body when the switch is in toggled engagement in the first position.

According to another aspect of the present invention, the fuse holder may be provided wherein one of the blocking device feature and the fuse holder feature includes a protrusion and wherein the other of the blocking device feature and the fuse holder feature includes a void.

According to another aspect of the present invention, the fuse holder may be provided wherein the fuse holder further includes fuse electrical contacts mounted to the body, the contacts having concave engagement surfaces adapted to engage opposed cylindrical electrical contacts of the fuse.

According to another aspect of the present invention, the fuse holder may be wherein the fuse carrier is separable from the body in a direction along the longitudinal axis of the fuse carrier.

According to another aspect of the present invention, the fuse holder may be provided wherein the blown fuse indicator is removeably securable to the fuse carrier body.

According to another embodiment of the invention, a fuse holder kit for use with a fuse is provided. The fuse holder kit includes a fuse holder, a first fuse carrier supportable at least partially in the fuse holder and adapted to hold a first fuse, and a second fuse carrier.

The second fuse carrier is supportable at least partially in the fuse holder holder and adapted to hold a second fuse. The fuse holder and the first fuse carrier provide a first fuse holder assembly with a first configuration and the fuse holder and the second fuse carrier provide a second first fuse holder assembly with a second configuration. The first configuration and the second configuration have at least one physical difference from each other.

According to another aspect of the present invention, the fuse holder kit may further include a blown fuse indicator. The blown fuse indicator is operable associable with at least one of the first fuse carrier and the second fuse carrier.

According to another aspect of the present invention, the fuse holder kit may be provided wherein the first fuse carrier defines a fuse carrier body having a blown fuse indicator receiving area for receiving at least a portion of the blown fuse indicator.

According to another aspect of the present invention, the fuse holder kit may be provided wherein the blown fuse indicator is fixedly secured to the first fuse carrier and wherein the first fuse carrier has a fuse carrier body thereof. The fuse carrier body defines an opening thereof adapted for receiving the first fuse. The fuse carrier body further defines a feature adapted to secure the blown fuse indicator to the fuse carrier.

According to another aspect of the present invention, the fuse holder kit may be provided wherein the blown fuse indicator may be removably secured to the first fuse carrier, whereby a blown fuse indicator may be replaced while not replacing the first fused carrier.

According to another aspect of the present invention, the fuse holder kit may be provided wherein the second fuse carrier is not adapted for receiving at least a portion of the blown fuse indicator, whereby the kit may be used to provide both fuse holders with a blown fuse indicator and fuse holders without a blown fuse indicator.

DETAILED DESCRIPTION OF THE INVENTION

The method, systems and apparatus described herein facilitate the construction and operation of a fuse holder for use in electrical circuits for example those circuits used in electrical transmission equipment.

Fuses are regularly used in electrical circuits to provide protection for electrical components from electrical overloads. Fuses are for example used in electrical transmission equipment to provide protection for electrical components from electrical surges originating from the power line or from excessive electrical loads. Replaceable fuses are often used. These replaceable fuses are often placed in electrical or fuse boxes. The electrical or fuse boxes may be located where they are not easily accessed and may be mounted in any orientation where space permits.

These replaceable fuses are consumed and provide an open circuit when exposed to a sufficient overload. Such replaceable fuses need to be replaced once consumed.

The fuses may need to be safely replaced without disenabling the power in the line. Once removed, it may be discovered that a replacement fuse is not available which may necessitate that access to a hot power line may need to be prevented when the fuse is not in the holder.

Some fuses are quite large and need to be inserted easily and safely into the fuse box, while not contacting the hot power line. The fuse boxes for these large fuses may accommodate may fuses and are inherently large. Minimizing the size of these fuse boxes may result in making access to the fuses more difficult, as sufficient space between adjacent fuses for accommodation for access by hands into the box may be compromised.

Figure 1:
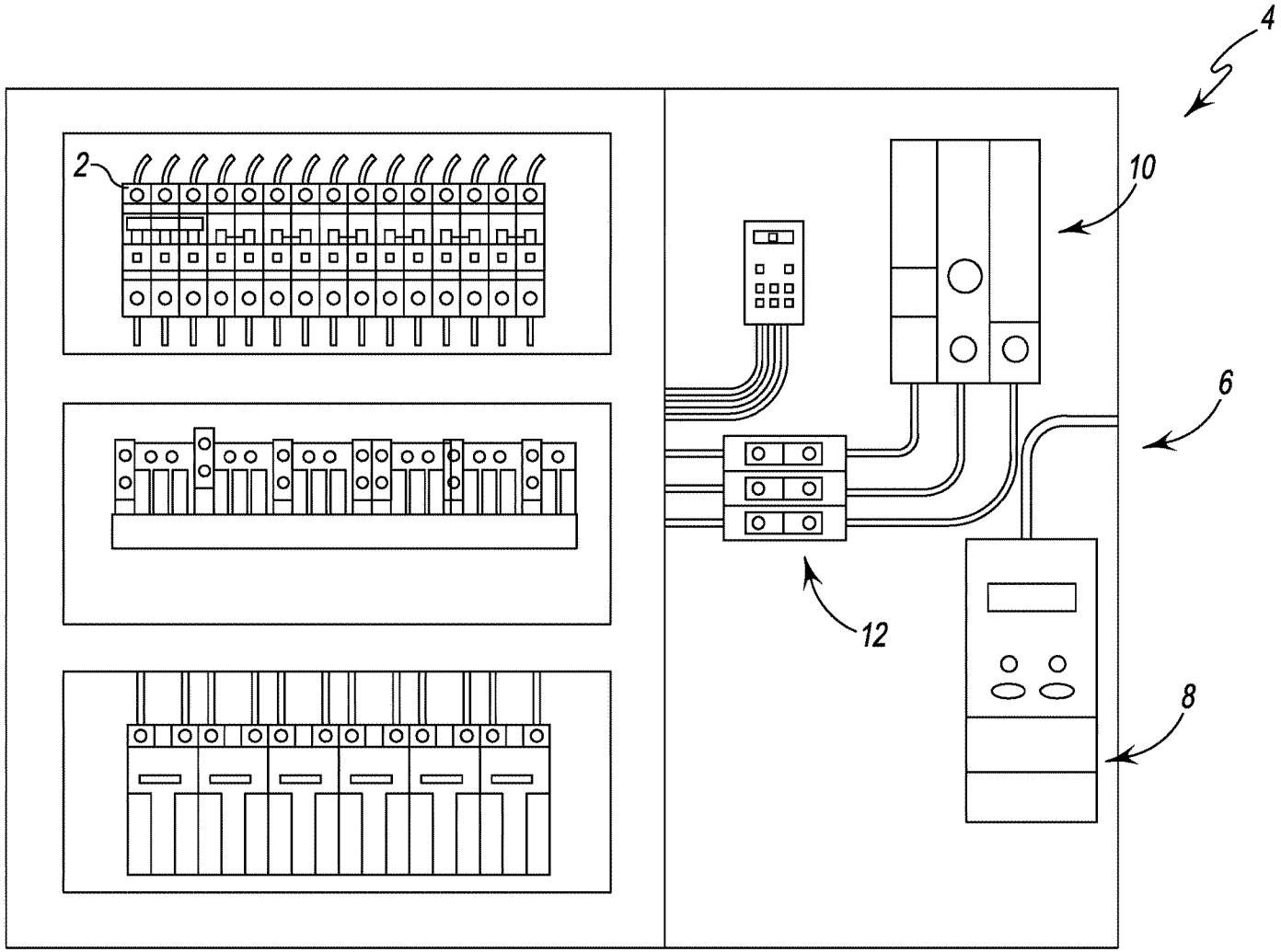
FIG. 1 is a plan view of a fuse panel in which the fuse holder of the present invention may be housed.
Figure 2:
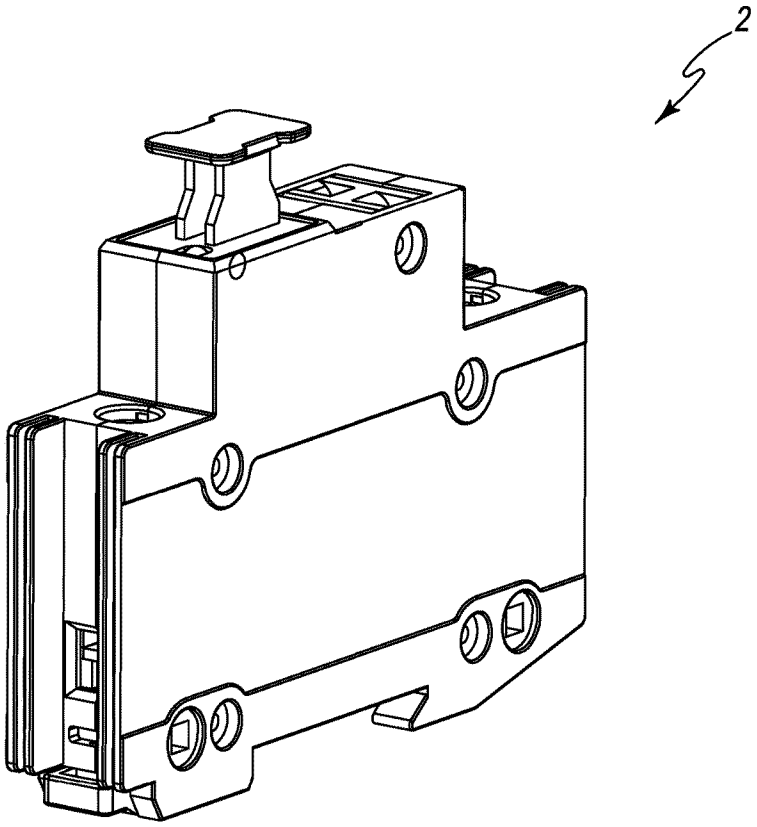
FIG. 2 is a perspective view a fuse holder according to an embodiment of the present invention.

According to an embodiment of the present invention and referring to FIGS. 1 and 2, a fuse holder 2 is shown. The fuse holder 2 is for use in electrical circuits where circuit protection is desired. The fuse holder 2 is well suited for use with electrically sensitive equipment where fast acting fuses are desired to provide such protection to sensitive equipment. It should be appreciated that the fuse holder 2 may be used wherever circuit protection is desired.

For example and referring to FIG. 1, the fuse holder 2 may be installed in, for example, a fuse or panel box 4. The panel box 4 may house a control system 6 include a controller 8. The controller 8 may, for example, be in the form of Programmable Logic Controller (PLC), a microprocessor, a micro controller or other controller. The control system 6 may further include a main disconnect 10 electrically connected to the controller 8. The main disconnect 10 is electrically connected to a power distribution block 12. The power distribution block 12 may be electrically connected to the fuse holder 2. Typically, the control system 6 includes a series of fuse holders 2 that are electrically connected to electrical devices (not shown) that the fuse holders 2 electrically protect.

According to an embodiment of the invention and referring now to FIGS. 2-10, the fuse holder 2 for holding a fuse 14 is shown. The fuse holder 2 includes a body 16, a line side connector 18 supported by the body 16, and a load side connector 20 supported by the body 16.

Figure 4:
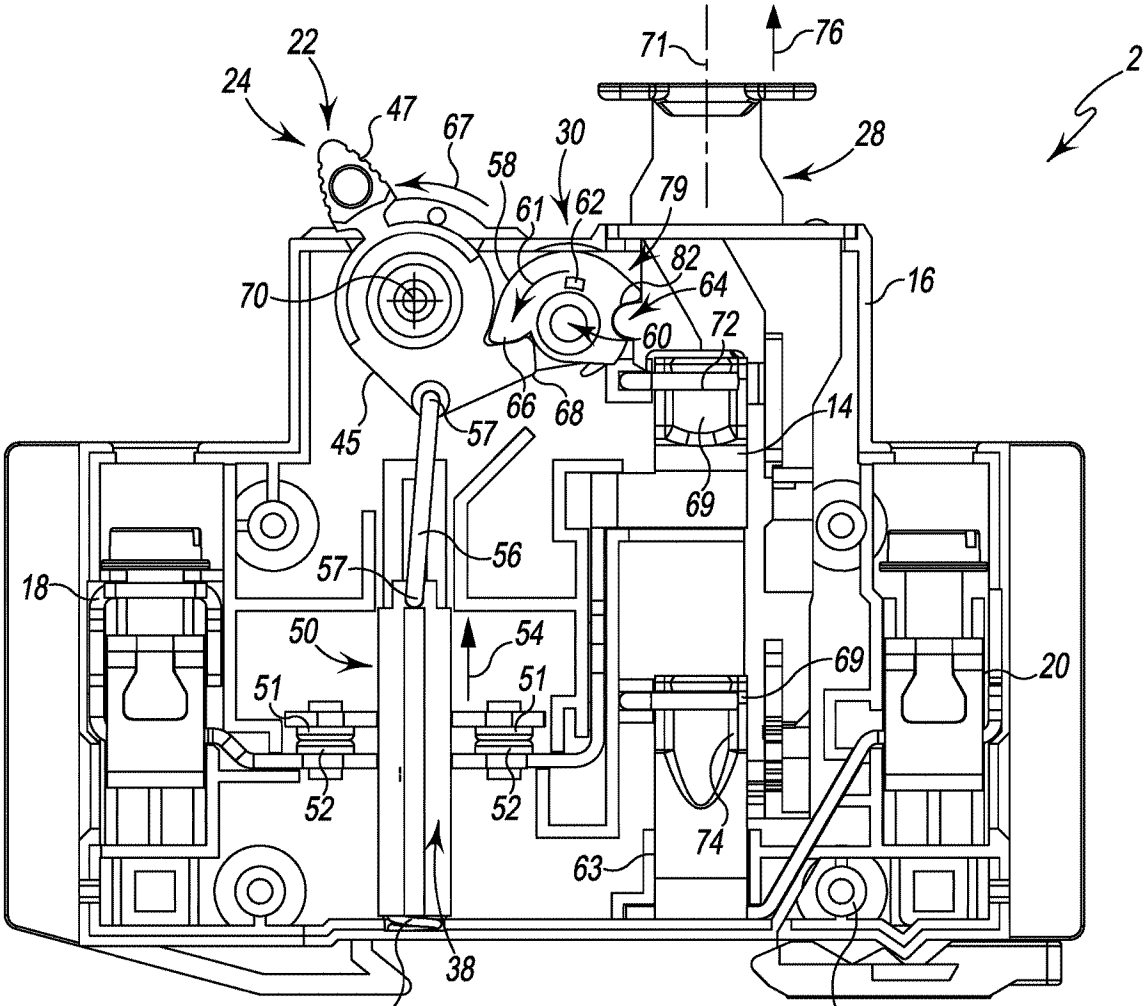
FIG. 4 a cross sectional view the fuse holder of FIG. 2 with the fuse holder in the electrically closed position and the fuse and fuse carrier in position in the fuse holder.
Figure 5:
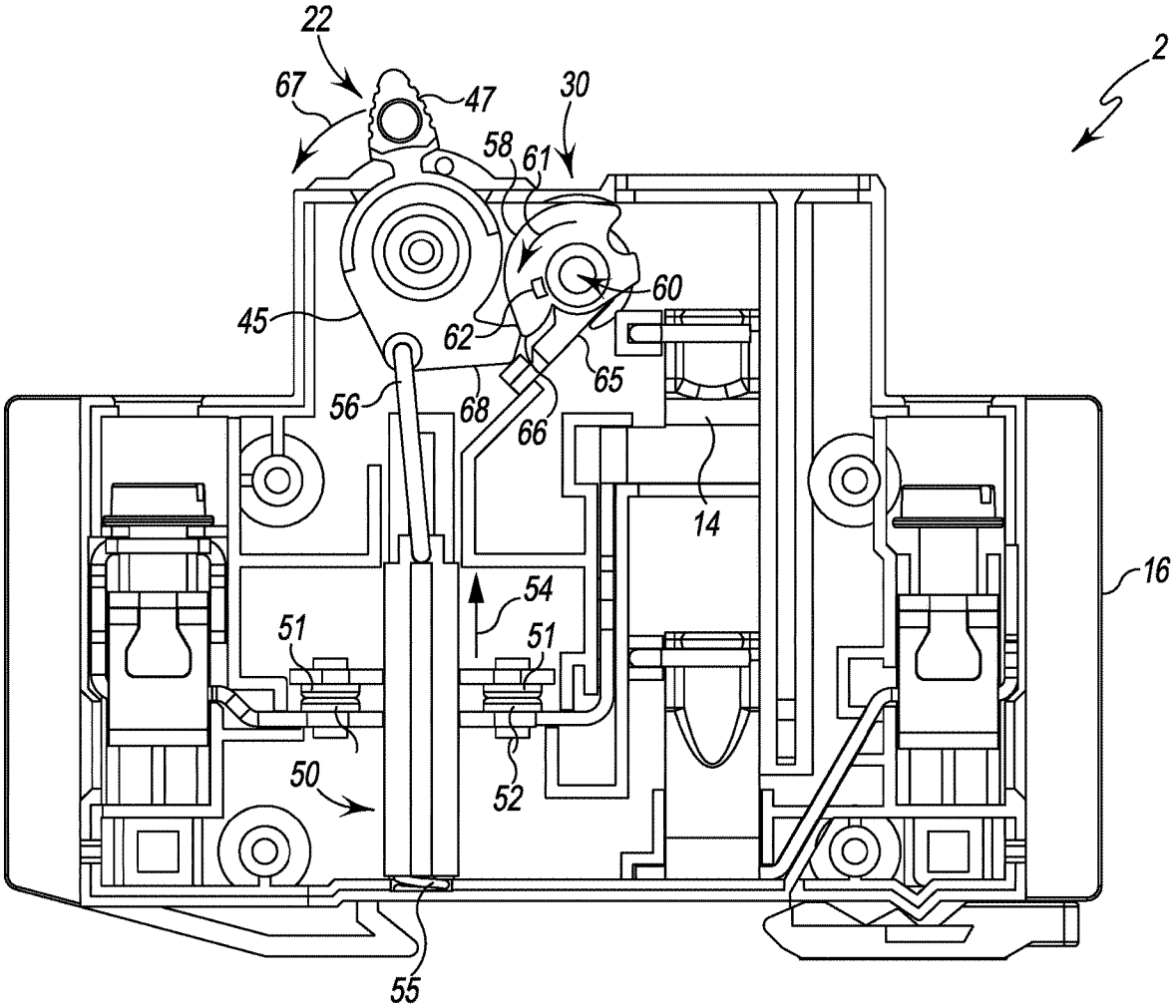
FIG. 5 a cross sectional view the fuse holder of FIG. 2 with the fuse holder in the electrically closed position with the fuse and fuse carrier removed.

The fuse holder 2 also includes a toggle switch 22 supported by the body 16. The switch 22 is capable of toggled engagement in a first position 24, as shown in FIG. 4, providing electrical connection between the line side connector 18 and the load side connector 20. The switch 22 is also capable of toggled engagement in a second position 26, as shown in FIG. 5, providing electrical isolation between the line side connector 18 and the load side connector 20.

The fuse holder 2 also includes a fuse carrier 28. The fuse carrier 28 is supported by the body 16. The fuse carrier 28 is adapted for holding the fuse 14 and the fuse carrier 28 is adapted to be removed from the fuse holder 2.

The fuse holder 2 also includes a blocking device 30 for blocking the toggled engagement of the switch 22 from the second position 26 to the first position 24 when the fuse carrier 28 is not located within the fuse holder 2.

The body 16 may be made of any suitable durable material. For example, the body 16 may be made of an electrically non-conductive material. For example, the body 16 may be made of a polymer, for example, a thermoplastic. For example, the body may be made of a nylon and may be glass filled.

The body 16 may be made by any suitable process and may, for example, be molded. The body 16 may be of unitary construction or may be made of multiple pieces or portions. For example, the body 16 may be molded and be made of two pieces or halves 32, each half being molded. The other components of the holder may be fitted in cavities 34 formed in the pieces 32. The pieces 32 may be fitted together by any suitable process, for example by gluing or by ultrasonic welding.

The body 16 may include protruding walls 36 and curved supports 38 to support and guide the other components in the holder 2. The body 16 may also include connectors 40 for connecting the halves 32 together. As shown in FIGS. 3-6, the connectors 40 are in the form of cylinders which may be hollow. Corresponding connectors 40 in the halves may matingly fit together.

The line side connector 18 and the load side connector 20 may have any shape and construction capable of receiving an electrical lead (not shown) in the form of a wire, solid or stranded, or an electrical lead connector (not shown). The line side connector 18 and the load side connector 20 may be similar or identical in construction and may include a threaded fastener 42 to urge conductive surfaces 44 together to contact the electrical leads. The line side connector 18 and the load side connector 20 may be secured in the cavities 34 of the body 16 positioned between adjacent protruding walls 36.

For proper use of the fuse holder 2, the fuse holder 2 should be manually toggled from the on position 24 to the off position 26 prior to any attempt to remove the fuse carrier 28. Doing so provides for the minimal wear of the components of the fuse holder 2. However, if an operator attempts to pull a fuse carrier 28 from the fuse holder 2, to reduce the adverse consequences of such improper use and according to another aspect of the present invention, the blocking device 30 may be adapted to urge the switch 22 from toggled engagement in the first position 24 to toggled engagement in the second position 26 as the fuse carrier 28 is removed from the fuse holder 2. It should be appreciated that if an when an operator incorrectly and against the instructions of the manufacturer attempts to pull the carrier 28 upwardly, with the switch 22 in the on position 24, with a removal force MRF, such force will be resisted by a force applied by the switch spring 55. If the switch spring 55 and the linking mechanism of the holder 2 is so selected, the MRF may be large enough to discourage such improper removal.

The switch 22 may be any device capable of interacting with the blocking device 30 and with the fuse carrier 28 to provide toggled engagement in a first position 24, providing electrical connection between the line side connector 18 and the load side connector 20, and capable of providing toggled engagement in a second position 26, providing electrical isolation between the line side connector 18 and the load side connector 20.

For example and as shown in FIG. 3-6, and according to another aspect of the present invention, the fuse holder 2 may be provided wherein the switch 22 includes a first portion 45. The first portion 45 includes an arm or lever 47. The first portion 45, as shown, may include a central opening 48 that is pivotally fitted to one of the connectors 40.

Figure 3:
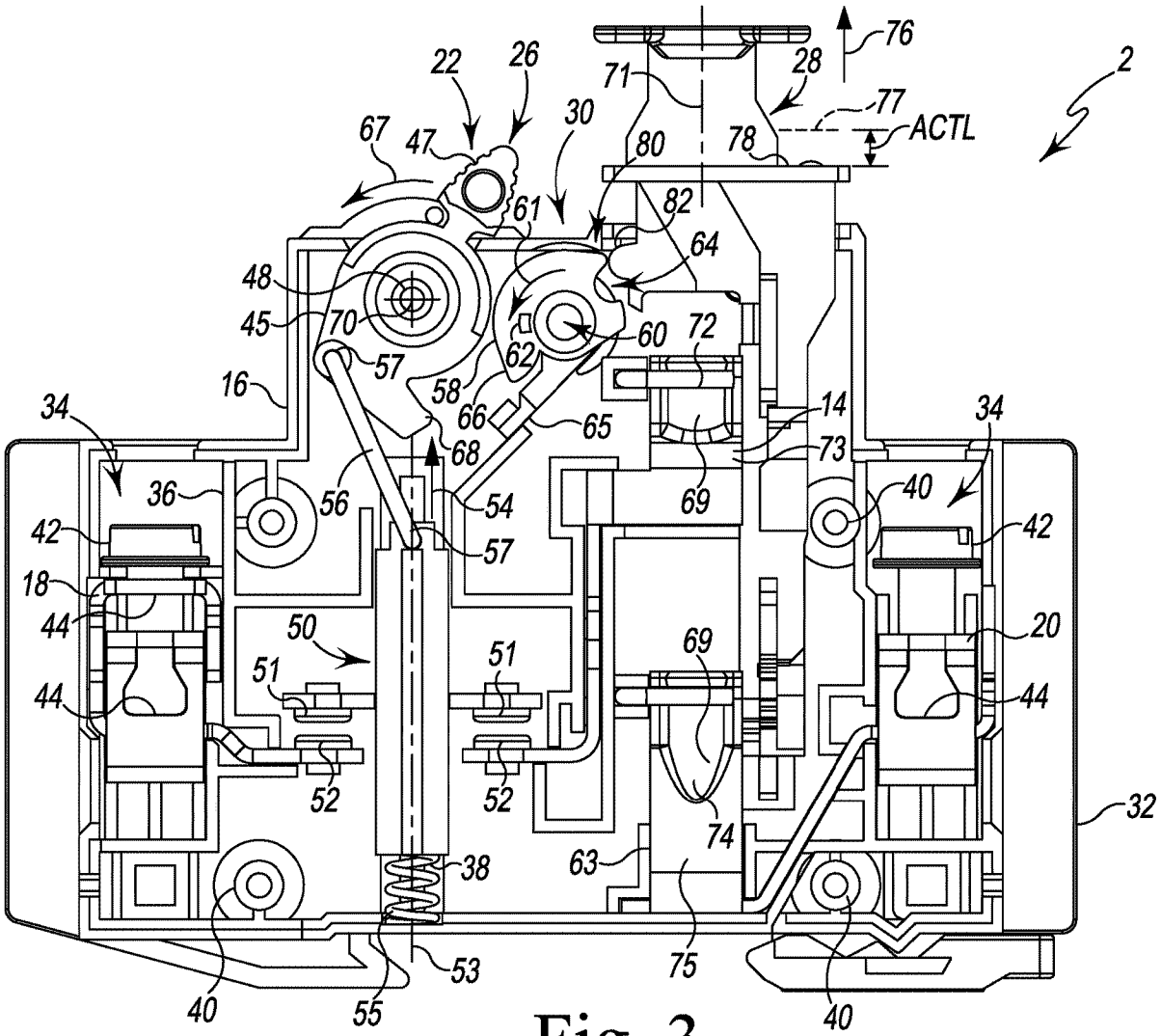
FIG. 3 a cross sectional view the fuse holder of FIG. 2 with the fuse holder in the electrically open position and the fuse and fuse carrier in position in the fuse holder.

The first portion 45, as shown, may pivot from the first position 24, shown in FIG. 4, to the second position 26, shown in FIG. 3.

The switch 22 may further include a second portion 50 that includes a pair of switch contacts 51 that may be selected to engage and disengage with a pair of body contacts 52 fixedly secured to the body 16 of the holder 2. The second portion 50 slides with respect to the body 2. As shown in FIGS. 3-6 the second portion 50 slides along longitudinal axis 53 of second portion 50 of switch 22, restrained by protruding walls 36 formed in the body 16 of holder 2. The second portion 50, as shown, is urged upwardly in the direction of arrow 54 by spring 55.

As shown in FIGS. 3-6 the second portion 50 is operably connected to the first portion 45. For example and as shown in FIGS. 3-6, the switch 22 includes a connecting rod 56. The connecting rod 56 includes ends 57 that are pivotally fitted into the first portion 45 and the second portion 50, respectively.

As shown in FIG. 4, the switch 22 provides electrical connection between the line side connector 18 and the load side connector 20 when the switch is in the first position 24. As shown in FIG. 3, the switch 22 provides electrical isolation between the line side connector 18 and the load side connector 20 when the switch is in the second position 26.

The blocking device 30 may be any device capable of interacting with the switch 22 and with the fuse carrier 28. For example and as shown in FIG. 3-6, the blocking device 30 includes a plate shaped cam 58 rotatable secured to the body 16 of the holder 2. The cam 58 may include a central opening 60 that is pivotally fitted to one of the connectors 40. The cam may be biased counterclockwise in the direction of arrow 61 by spring 62.

The cam 58 may define a void or cylindrical pocket 64 for cooperating with the fuse carrier 28 and an arm 65 for limiting the pivoting of the cam as it contacts protruding wall 36. Note that the arm 65 is in a different plane than the first portion 45 of the switch and does not cooperate with the switch 22. The cam may further define a cam high point or protuberance 66 for cooperation with the switch 22.

Figure 6:
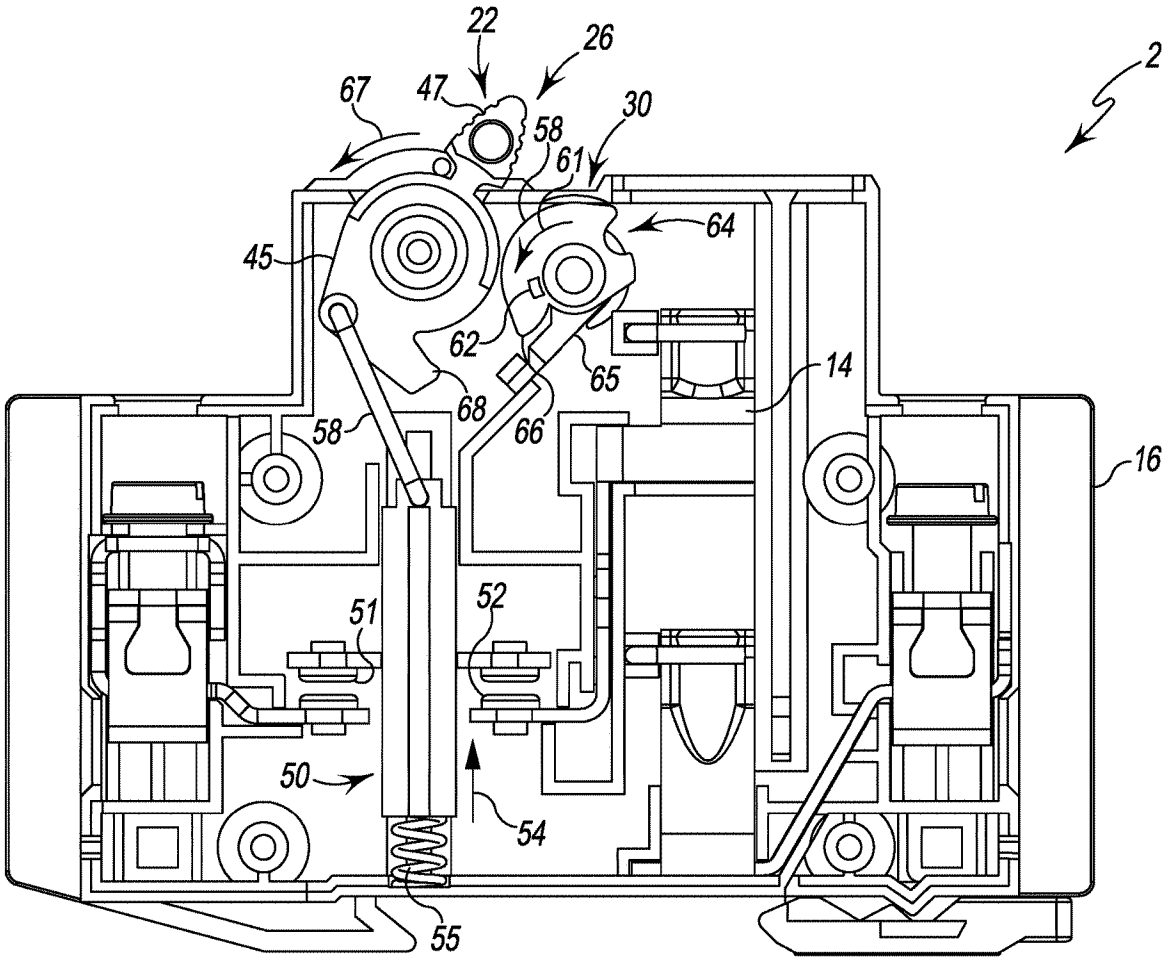
FIG. 6 a cross sectional view the fuse holder of FIG. 2 with the fuse holder in the electrically open position with the fuse and fuse carrier removed.
Figure 7:
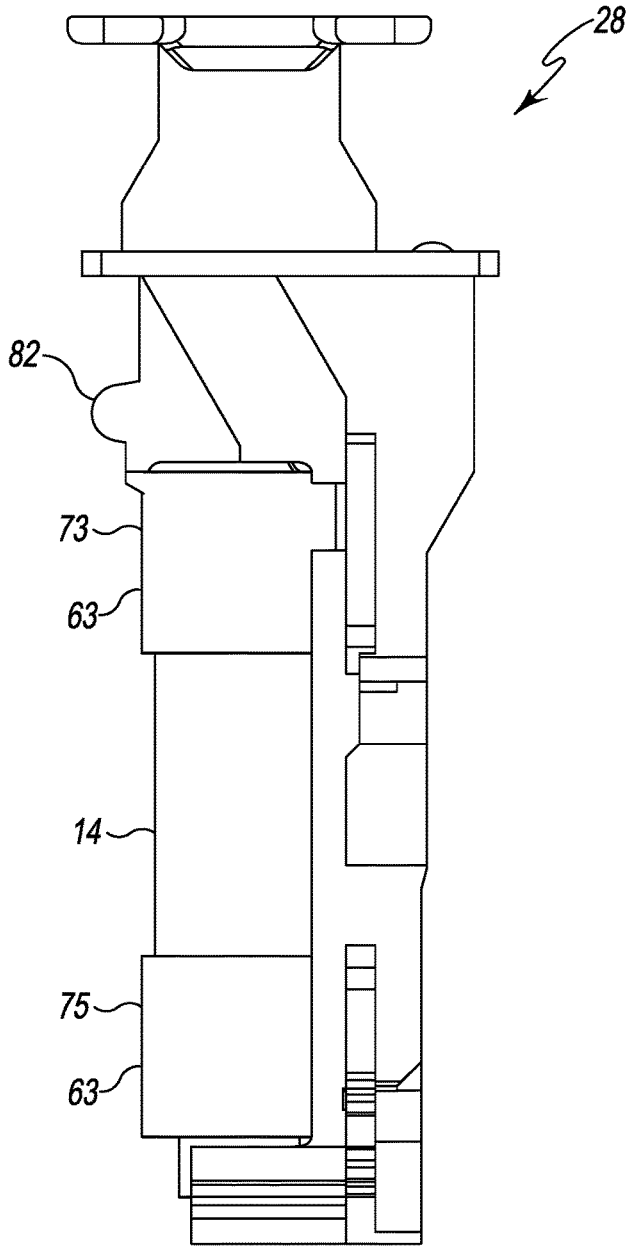
FIG. 7 is a plan view of the fuse and fuse carrier for use with the fuse holder of FIG. 2.

As shown if FIGS. 5-6, the fuse holder is shown with the fuse carrier 28 removed. The fuse holder 2, as shown in FIGS. 5-6, blocks the toggled engagement of the switch 22 from the off or second position 26 to the on or first position 24 when the fuse carrier 28 is not located within the fuse holder 2.

This blocking may be accomplished in any suitable manner. For example and as shown in FIG. 5, the cam 58 is biased in the direction of arrow 61 by spring 62, causing the arm 65 of cam 58 to lodge into protruding wall 36 of body 16 of holder 2, limiting the rotation of the blocking device 30 in the direction of arrow 61.

If the switch 22 is attempted to be moved from the second or off position 26 to the first or on position 24 in the direction of arrow 67, leg 68 of first portion 45 of switch 22 engages the protuberance 66 of cam 58 of blocking device 30, limiting the movement of the first portion 45 of the switch 22 in the direction of arrow 67.

At this position of the switch 22 as shown in FIG. 5, the upper end 57 of the connecting rod 56 is to the left of the longitudinal axis 53 of the second portion 50 and to the left of rotational axis 70 of the first portion 45 of switch 22. In this position, the spring 55 is selected to have a spring force sufficient to rotate the first portion 45 of switch 22 in a clockwise direction opposed to arrow 67 to the second or off position 26 of switch 22, as shown in FIG. 6.

Referring to FIG. 5, an operator may, even though it is not recommended, attempt to rotate the switch 22 to the on position when the fuse carrier 28 is not in the fuse holder 2. When an operator does so, the line side fuse electrical contact 72 may touch the load side fuse electrical contact 74 while the operator is pushing the switch toward to on position. As soon as the operator releases the switch 22 the switch returns to the off position 26.

According to another aspect of the present invention and as shown in FIGS. 2-4, the fuse holder 2 may be provided wherein the fuse carrier 28 defines a longitudinal axis 71 and wherein the fuse carrier 2 is separable from the body 16 of the holder 2 in a direction along the longitudinal axis 71 of the fuse carrier 28. This separation configuration for the carrier 28 permits the fuse holder to be smaller than other configurations, particularly in width and length (the directions normal to the longitudinal axis 71). Further, this configuration is simple and rugged.

According to another aspect of the present invention and referring to FIGS. 2-10, the fuse holder 2 may be provided wherein the line side connector 18 includes a line side fuse electrical contact 72 for electrical connection with a first end 73 of the fuse 14 and wherein the load side connector 20 includes a load side fuse electrical contact 74 for electrical connection with a second end 75 of the fuse 14. The second end 75 is opposed to the first end 73 of the fuse 14.

According to another aspect of the present invention and referring to FIGS. 3-6, the fuse holder 2 and the blocking device 30 may be adapted to provide for toggled engagement of the switch 22 in the second or off position 26 prior to the electrical disengagement of at least one of first end 73 of the fuse 14 to the line side connector 18 and second end of the fuse 14 to the load side connector 20 as the fuse carrier 28 is removed from the fuse holder 2.

This toggled engagement of the switch 22 in the second or off position 26 prior to the electrical disengagement of the fuse 14 may be accomplished by any configuration capable of providing such engagement.

Figure 8:
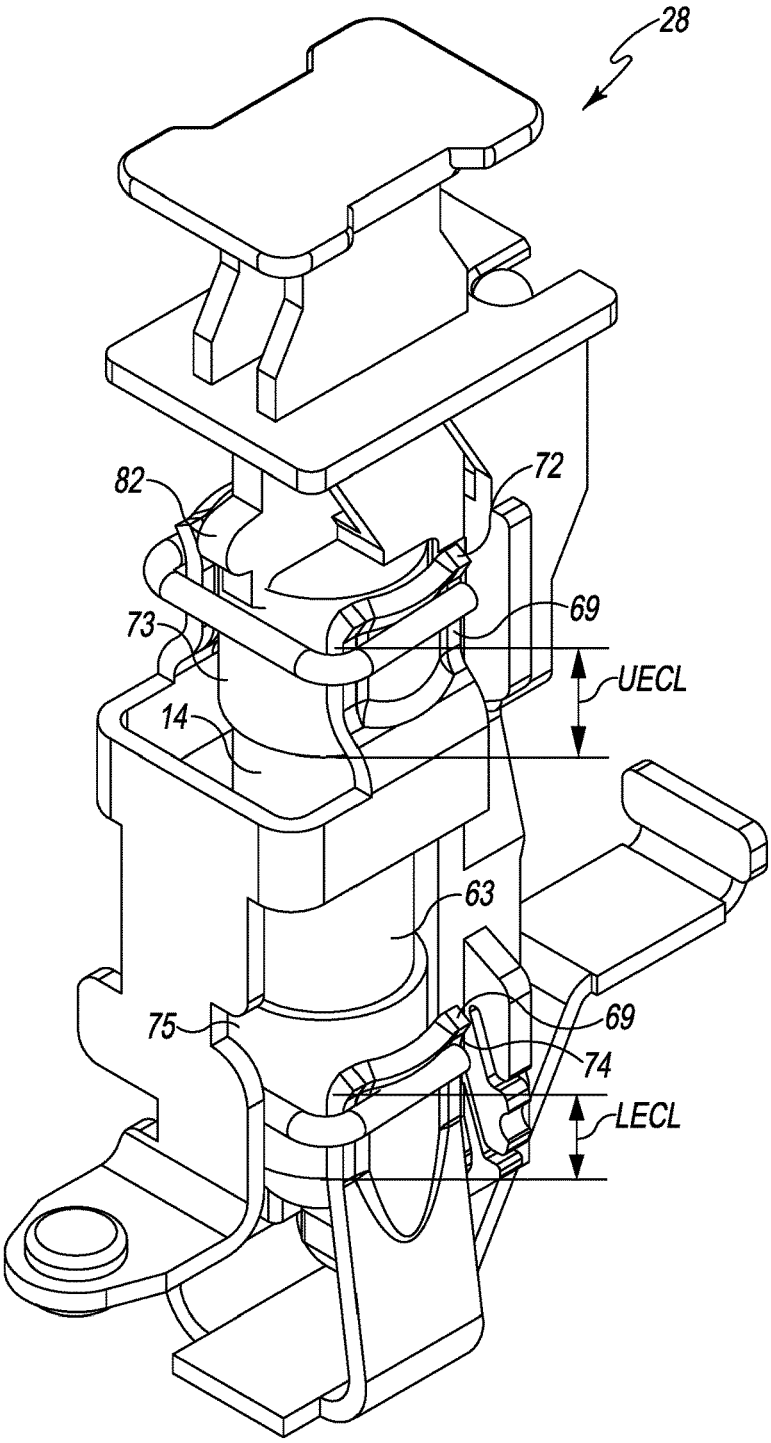
FIG. 8 is a perspective view of the fuse and fuse carrier of FIG. 6.

For example and as shown in FIG. 8, when the fuse carrier 28 is fully engaged in the fuse holder 2, the line side electrical contact 72 engages the first end 73 of the contact of the fuse 14 an upper electrical contact length UECL and the load side electrical contact 74 engages the second end 75 of the contact of the fuse 14 an lower electrical contact length LECL. As the fuse carrier 28 is extracted from the fuse holder 2 in the direction of arrow 76, the axial lengths UECL and LECL decrease.

Referring to FIGS. 3-6, as the fuse carrier 28 is extracted from the fuse holder 2 in the direction of arrow 76 the fuse carrier 28 moves an axial length CALM representing the axial length of motion of the fuse carrier 28 in the direction of arrow 76 necessary to flip the switch 22 from the first or on position 24 (see FIG. 4) to the second or off position 26 (see FIG. 3). Note that in FIG. 3 the fuse carrier 28 is shown in phantom line 77 fully engaged in the fuse holder 2 and in solid line 78 moved the carrier axial length of motion CALM representing the axial length of motion of the fuse carrier 28 in the direction of arrow 76 necessary to flip the switch 22 from the first or on position 24 to the second or off position 26.

As described in greater detail above, as the fuse carrier 28 moves in the direction of arrow 76, the biasing device 30 rotates in the direction of arrow 61 urging the first portion 45 of the switch 22 in the direction opposed to arrow 67, causing the switch to flip from the position in FIG. 5 to the position in FIG. 3, placing the switch 22 in the second or off position 26.

As long as the fuse holder 2 and fuse carrier 28 are designed so that the fuse holder/carrier electrical contact lengths UECL and LECL are greater than the axial length of motion ACTL of the fuse carrier 28, the switch 22 will be toggled to the second or off position 26 prior to the electrical disengagement of at least one of first end 73 of the fuse 14 to the line side connector 18 and second end of the fuse 14 to the load side connector 20 as the fuse carrier 28 is removed from the fuse holder 2. This configuration will minimize electrical arching between the contacts 72 and 74 and the ends 73 and 75 of the fuse 14, respectively.

The contacts 72 and 74 may have any configuration. For example for use with a cylindrical fuse, the contacts 72 and 74 may have concave engagement surfaces 69 adapted to engage opposed cylindrical or convex electrical contacts 63 of the fuse 14.

Referring to FIGS. 3-6 and according to another aspect of the present invention, the fuse holder 2 may be provided wherein the blocking device 30 has a first position 79 for blocking the removal of the fuse carrier 28 from the body 16 when the switch 22 is in toggled engagement in the first position 24 and wherein the blocking device 30 has a second position 80 for permitting the removal of the fuse carrier 28 from the body 16 when the switch 22 is in toggled engagement in the second position 80.

It should be appreciated that the fuse holder and the blocking device may have several configurations to accomplish the above described first and second positions 79 and 80, respectively.

For example and as shown in FIGS. 3 and 4, the blocking device 30, as shown in FIG. 3, has a first position 79 for permitting the removal of the fuse carrier 28 from the body 16 when the switch 22 is in toggled engagement in the second or off position 26. In this first position 24, the spring 62 of the blocking device 30 urges the arm 65 of the blocking device 30 into engagement with the protruding wall 36 of the body 16 of the fuse holder 2. In this position of the blocking device 30, the void or cylindrical pocket 64 of the blocking device is rotated in the direction of arrow 61, out of engagement with the fuse carrier 28. Also, the spring 55 of the switch 22 urges the first portion 45 of the switch 22 in the direction opposed to arrow 67 to the second or off position 26. This configuration permits removal of the fuse holder 2 when the switch 22 is in the second or off position 26.

For example and as shown in FIGS. 3 and 4, the blocking device 30, as shown in FIG. 4, has a second position 80 for blocking the removal of the fuse carrier 28 from the body 16 when the switch 22 is in toggled engagement in the first or on position 24. In this first position 24, the spring 62 of the blocking device 30 urges the protuberance 66 of the blocking device 30 into engagement with the arm 47 of the first portion 45 of the switch 22. Similarly, the spring 55 of the switch 22 urges the arm 47 of the first portion 45 of the switch 22 into engagement with the protuberance 66 of the blocking device 30. This configuration blocks removal of the fuse holder when the switch 22 is in the first or on position 24.

According to another aspect of the present invention, the fuse holder 2 may be provided wherein the blocking device 30 includes blocking device feature 64 and wherein the fuse holder 28 includes a fuse carrier feature 82 for cooperation with the blocking device feature 64 for blocking the removal of the fuse carrier 28 from the body 2 when the switch 22 is in the first position 24.

The blocking device feature 64 and the fuse carrier feature 82 may be designed to be any cooperating features such as voids and protrusion, mating parts, for examples gears (not shown). As shown in FIGS. 3-6, the blocking device feature 64 is in the form of a void, for example a cylindrical pocket. and the fuse carrier feature 82 is in the form of a protrusions, for example a convex or cylindrical protrusion.

Figure 9:
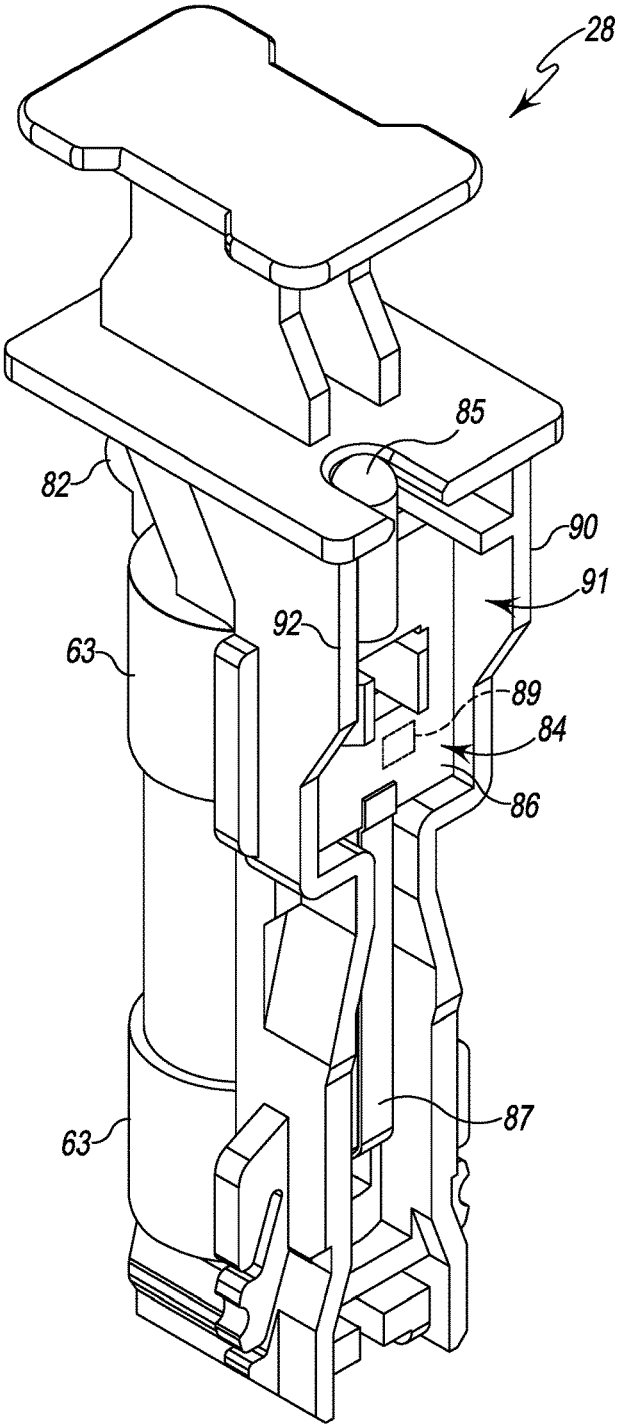
FIG. 9 is another perspective view of the fuse and fuse carrier of FIG. 6 showing the fuse presence indicator.
Figure 10:
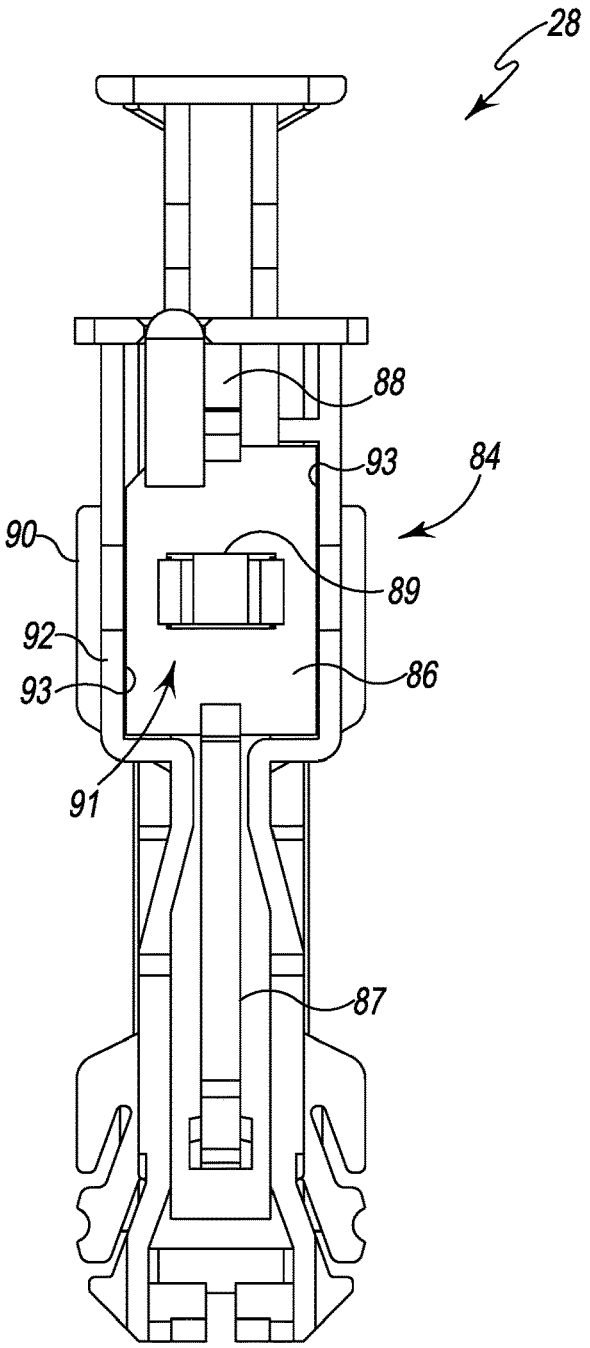
FIG. 10 is yet another perspective view of the fuse and fuse carrier of FIG. 6 showing the fuse presence indicator in greater detail.

As shown in FIGS. 8-10, the fuse holder 2 may be provided wherein the fuse holder 2 further includes an indicating module 84 for indicating that a fuse 14 is not functioning properly. The indicating module 84 may include an indicator 85 that indicates when the fuse 14 is not functioning properly. The indicator 85 may be an illumination device. The indication module 84 may have a body 86 form which a load side electrical lead 87 and a line side electrical lead 88 extend. The body may house an electrical circuit 89. The electrical circuit 89 may have very high resistance such that when the fuse is blown a very low leakage current will pass through the circuit 89 of the indicating module 84, illuminating the indicator 85.

Figure 12:
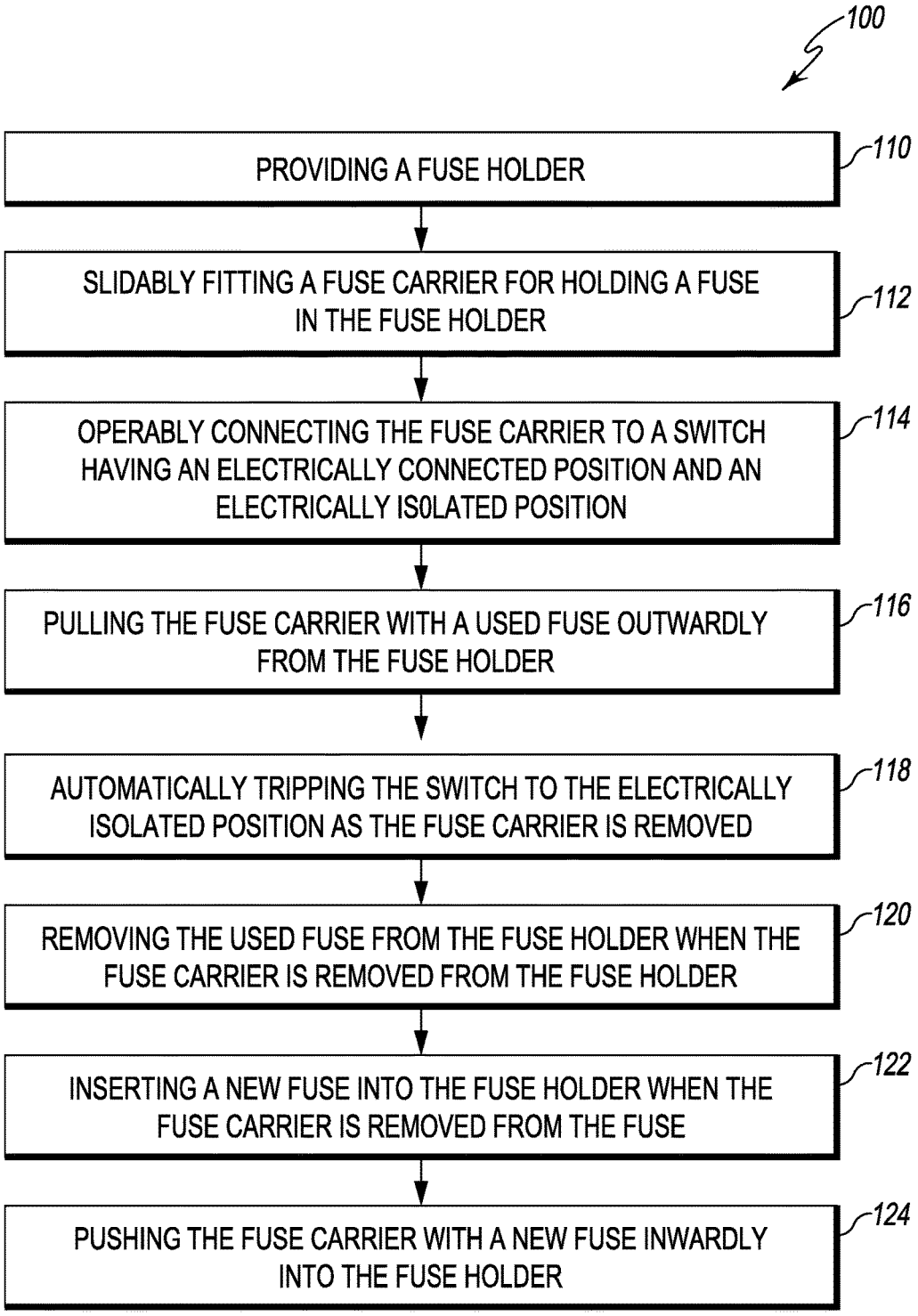
FIG. 12 is a flow chart of another embodiment of the present invention in the form of a method for using a fuse holder.

According to another embodiment of the invention and referring to FIG. 12, a method 100 for replacement of a fuse to and from a fuse holder is provided. The method includes step 110 of providing a fuse holder and step 112 of slidably fitting a fuse carrier for holding a fuse in the fuse holder. The method also includes step 114 of operably connecting the fuse carrier to a switch having an electrically connected position and an electrically isolated position, and step 116 of pulling the fuse carrier with a used fuse outwardly from the fuse holder.

The method further includes step 118 of automatically tripping the switch to the electrically isolated position as the fuse carrier is removed and step 120 of removing the used fuse from the fuse holder when the fuse carrier is removed from the fuse holder. The method further includes step 122 of inserting a new fuse into the fuse holder when the fuse carrier is removed from the fuse holder and step 124 of pushing the fuse carrier with a new fuse inwardly into the fuse holder.

According to another embodiment of the invention and referring to FIGS. 3-10, fuse carrier 28 for use with fuse holder 2 is provided. The fuse holder 2 has a toggle switch 22 for selectively providing an electrical isolation and an electrical connection between a line side connector 18 and a load side connector 20. The fuse carrier 28 includes a fuse carrier body 90 defining an opening 91 thereof adapted for receiving the fuse 14.

For proper use of the fuse holder 2, the fuse holder 2 should be manually toggled from the on position 24 to the off position 26 prior to any attempt to remove the fuse carrier 28. Doing so provides for the minimal wear of the components of the fuse holder 2. However, if an operator attempts to pull a fuse carrier 28 from the fuse holder 2, to reduce the adverse consequences of such improper use and according to another aspect of the present invention, the fuse carrier body 90 defines a fuse holder feature 82 for cooperation with the switch 22 for urging the switch 22 from toggled engagement in the first position 24 to toggled engagement in the second position 26 as the fuse carrier 28 is removed from the fuse holder 2.

According to another embodiment of the invention and referring to FIGS. 8-10, fuse carrier 28 for use with fuse holder 2 and indication module or blown fuse indicator 84 is provided. The fuse carrier 28 includes fuse carrier body 90 defining opening 91 thereof adapted for receiving the fuse 14. The fuse carrier body 90 further defines feature (for example a portion of body wall 92 adapted to secure the blown fuse indicator 84 to the fuse carrier body 90.

According to another aspect of the present invention, the fuse carrier 28 may be provided wherein the fuse carrier 28 is further adapted for use in fuse holder 2 having a toggle switch 22 for selectively providing toggled engagement in first position 24 providing an electrical connection and toggled engagement in second position 26 providing an electrical isolation between line side connector 18 and load side connector 20. The fuse carrier body 90 defines a feature 82 for cooperation with the switch 22 (through the void 64 of the blocking device 30) for urging the switch 22 into toggled engagement in the first position 24 when the fuse carrier is in position in the fuse holder. Note that when the operator moves the switch 22 from the first or on position 24, as shown in FIG. 4, to the second or off position 26, as shown in FIG. 5, the spring 55 biases the switch 22 to stay in the off position 26.

As shown in FIG. 10 and according to another aspect of the present invention, the fuse carrier 28 may be provided wherein the blown fuse indicator or indication module 84 is removeably securable to the fuse carrier body 90. While such modularity or ability to remove the module 84 may be accomplished in any suitable manner, for example and as shown in FIG. 10, the fuse carrier body 90 may have retention tabs 93 in body wall 90 so that the module 84 may be secured to the carrier 28 while being easily installed and removed from the carrier 28.

Figure 11:
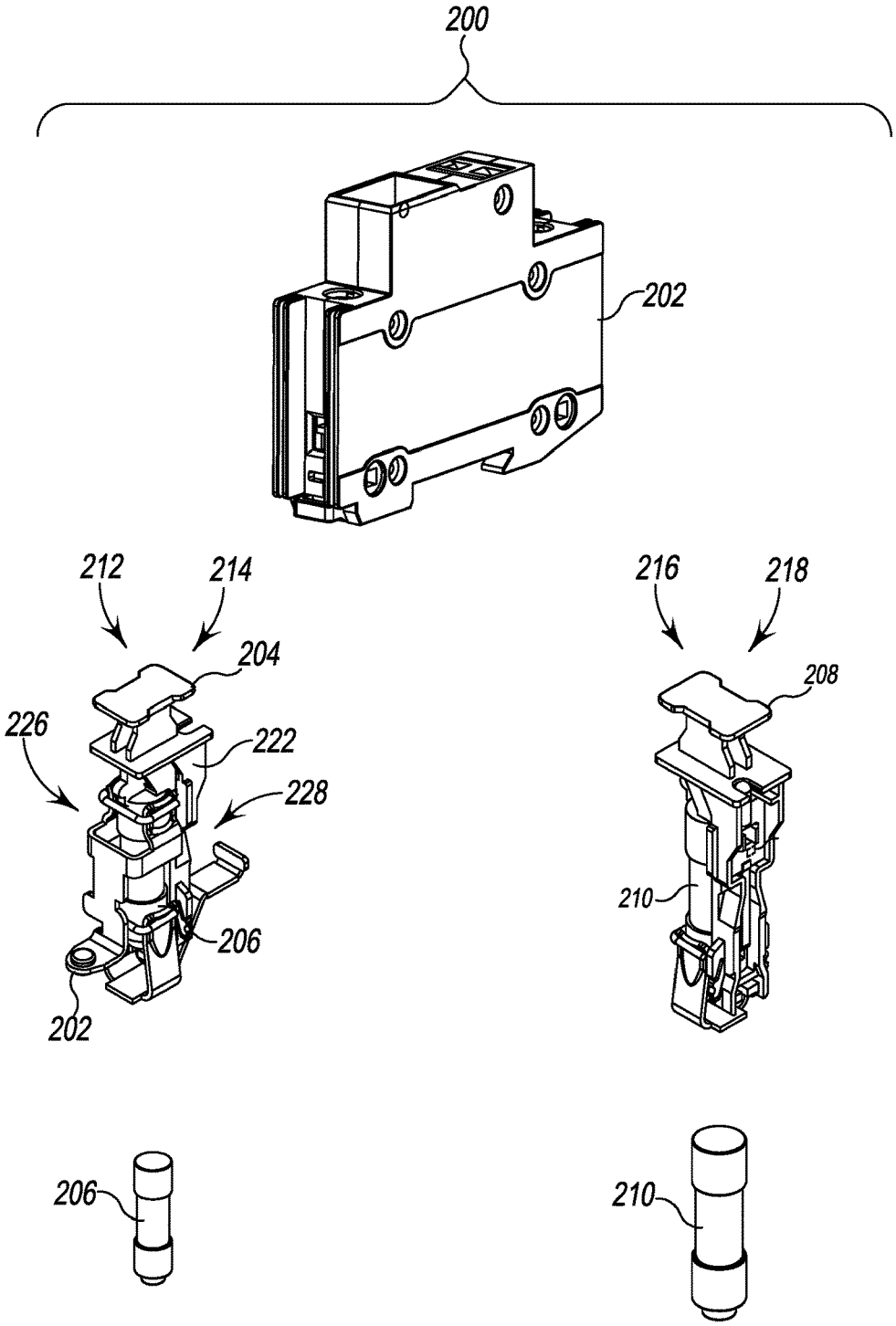
FIG. 11 is a perspective view of a kit of fuse holders and fuse carriers according to another embodiment of the invention.

According to another embodiment of the invention and referring to FIG. 11, a fuse holder kit 200 for use with a fuse is provided. The fuse holder kit 200 includes a first fuse holder 202, a first fuse carrier 204 supportable at least partially in the fuse holder 202 and adapted to hold a first fuse 206, and a second fuse carrier 208.

The first fuse holder 202 is similar to the fuse holder 2 of FIGS. 2-10. The first fuse carrier 204 and the second fuse carrier are similar to the fuse carrier 28 of FIGS. 2-10. The first fuse 206 and the second fuse are similar to the fuse 14 of FIGS. 2-10.

The second fuse carrier 208 is supportable at least partially in the first fuse holder 202 and adapted to hold a second fuse 210. The first fuse holder 202 and the first fuse carrier 204 provide a first fuse holder assembly 212 with a first configuration 214 and the first fuse holder 202 and the second fuse carrier 208 provide a second fuse holder assembly 216 with a second configuration 218. The first configuration 214 and the second configuration 218 have at least one physical difference from each other. For example, the first fuse 206 and the second fuse 210 may have different amperage ratings and may have different lengths or diameters.

According to another aspect of the present invention, the fuse holder kit 200 may further include a blown fuse indicator 220. The blown fuse indicator 220 is similar to the blown fuse indicator 84 of FIGS. 2-10. The blown fuse indicator 220 is operable associable with at least one of the first fuse carrier 204 and the second fuse carrier 208.

According to another aspect of the present invention, the fuse holder kit 200 may be provided wherein the first fuse carrier 204 defines a fuse carrier body 222 having a blown fuse indicator receiving area 224 for receiving at least a portion of the blown fuse indicator 220.

According to another aspect of the present invention, the fuse holder kit 200 may be provided wherein the blown fuse indicator 220 is fixedly secured to the first fuse carrier 204 and wherein the first fuse carrier 204 has first fuse carrier body 222. The first fuse carrier body 222 defines an opening 226 adapted for receiving the first fuse 206. The first fuse carrier body 222 further defines a feature 228 adapted to secure the blown fuse indicator 220 to the first fuse carrier 204.

According to another aspect of the present invention, the fuse holder kit 200 may be provided wherein the blown fuse indicator 220 may be removably secured to the first fuse carrier 204, whereby a blown fuse indicator may be replaced while not replacing the first fuse carrier 204.

According to another aspect of the present invention, the fuse holder kit 200 may be provided wherein the second fuse carrier 208 is not adapted for receiving at least a portion of the blown fuse indicator 220, whereby the kit 200 may be used to provide both fuse holders with a blown fuse indicator and fuse holders without a blown fuse indicator.

The methods, systems, and apparatus described herein facilitate efficient and economical manufacturing and use of a fuse holder and fuse carrier that is utilized in a circuit or fuse box. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional elements)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing a simple efficient device to contain for operation and to replace when needed a fuse. The methods, system and apparatus described herein may be used in any suitable application. However, they are particularly suited for electrical circuits where load protection is desired.

Exemplary embodiments of the fuse holder, fuse carrier and method are described above in detail. The fuse holder, fuse carrier and method are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse holder for holding a fuse, comprising:

a body;

a line side connector supported by said body;

a load side connector supported by said body;

a switch pivotably supported by said body about a first axis, said switch being capable of engagement in a first position providing electrical connection between said line side connector and said load side connector and said switch being capable of engagement in a second position providing electrical isolation between said line side connector and said load side connector;

a fuse carrier, said fuse carrier supported by said body, said fuse carrier holding the fuse when the fuse is assembled into the fuse carrier and said fuse carrier adapted to be removed from said fuse holder, said fuse holder including a first fuse holder conductor in electrical engagement with a first end of the fuse when the fuse is assembled into the fuse holder and a second fuse holder conductor in electrical engagement with a second end of the fuse when the fuse is assembled into the fuse holder, said first fuse holder conductor electrically connected to one of the line side connector and the load side connector when the fuse holder is in an operating position, said second fuse holder conductor electrically connected to the other of the line side connector and the load side connector when the fuse holder is in an operating position; and a cam pivotably supported by said body about a second axis spaced from said first axis, said cam connected to said switch and engageable with said fuse carrier to block the advancement of the fuse carrier into the body.

2. The fuse holder as in claim 1, wherein said cam is adapted to urge said switch from toggled engagement in said first position to toggled engagement in said second position as said fuse carrier is removed from said fuse holder.

3. The fuse holder as in claim 1:

wherein said fuse carrier defines a longitudinal axis; and wherein said fuse carrier is separable from said body in a direction along the longitudinal axis of said fuse carrier.

4. The fuse holder as in claim 1:

wherein said switch includes a first portion that pivots from the first position providing electrical connection between said line side connector and said load side connector to the second position providing electrical isolation between said line side connector and said load side connector; and wherein said switch includes a second portion that includes a pair of switch contacts that selectably engage and disengage with a pair of body contacts fixedly secured to said body, the second portion slidably movable with respect to said body, the second portion operably connected to the first portion.

5. The fuse holder as in claim 1, wherein said fuse holder is adapted to provide for toggled engagement of the switch in the second position prior to the electrical disengagement of at least one of first end of said fuse to the line side connector and second end of said fuse to the load side connector as said fuse carrier is removed from said fuse holder.

6. The fuse holder as in claim 2:

wherein said cam has a first position for blocking the removal of the fuse carrier from said body when said switch is in toggled engagement in said first position; and wherein said cam has a second position for permitting the removal of the fuse carrier from said body when said switch is in toggled engagement in said second position.

7. The fuse holder as in claim 1:

wherein said cam comprises a blocking device feature; and wherein said fuse holder comprises a fuse holder feature for cooperation with the blocking device feature for blocking the removal of the fuse carrier from said body when said switch is in toggled engagement in said first position.

8. The fuse holder as in claim 7:

wherein one of said blocking device feature and said fuse holder feature comprises a protrusion; and wherein the other of said blocking device feature and said fuse holder feature comprises a void.

9. The fuse holder as in claim 1, wherein said fuse holder further comprises fuse electrical contacts mounted to said body, the contacts having concave engagement surfaces adapted to engage opposed cylindrical electrical contacts of the fuse.

10. The fuse holder as in claim 1, wherein said fuse carrier further comprises an indicating module for indicating that a fuse is not functioning properly.

11. The fuse holder as in claim 1:

wherein said cam defines one of a pocket and a protrusion; and wherein said fuse carrier defines the other of a pocket and a protrusion, the protrusion engaging the pocket to rotate said cam as said fuse carrier is separated from the body in a direction along the longitudinal axis of said fuse carrier.

12. A fuse holder for holding a fuse, comprising:

a body;

a line side connector supported by said body;

a load side connector supported by said body;

a switch providing electrical connection between said line side connector and said load side connector in a first position and said switch providing electrical isolation between said line side connector and said load side connector in a second position, different from the first position;

a fuse carrier, said fuse carrier supported by said body, said fuse carrier holding the fuse when the fuse is assembled into the fuse carrier and said fuse carrier removeable from said fuse holder, said fuse holder including a first fuse holder conductor in electrical engagement with a first end of the fuse when the fuse is assembled into the fuse holder and a second fuse holder conductor in electrical engagement with a second end of the fuse when the fuse is assembled into the fuse holder, said first fuse holder conductor electrically connected to one of the line side connector and the load side connector when the fuse holder is in an operating position, said second fuse holder conductor electrically connected to the other of the line side connector and the load side connector when the fuse holder is in an operating position; and a cam pivotably supported by said body about a first axis, said cam connected to said switch, said cam having a cam feature in intimate engagement with a fuse carrier feature to block the advancement of the fuse carrier into the body when the cam is in a first angular orientation relative to said body, the cam having a second angular orientation relative to said body, different than the first angular orientation, the second angular orientation permitting the advancement of the fuse carrier into the body.

13. The fuse holder as in claim 12, wherein said cam urges said switch from said first position to said second position as said fuse carrier is removed from said fuse holder.

14. The fuse holder as in claim 12,

Wherein said cam feature comprises a void and wherein said fuse carrier feature comprises a protrusion.

15. The fuse holder as in claim 12, wherein said switch is pivotably supported by said body about a second axis spaced from the first axis.

16. A fuse holder for holding a fuse, comprising:

a body;

a line side connector supported by said body;

a load side connector supported by said body;

a switch pivotably supported by said body about a first axis, said switch providing electrical connection between said line side connector and said load side connector in a first position and said switch providing electrical isolation between said line side connector and said load side connector in a second position, different from the first position;

a fuse carrier, said fuse carrier supported by said body, said fuse carrier holding the fuse when the fuse is assembled into the fuse carrier and said fuse carrier removeable from said fuse holder, said fuse holder including a first fuse holder conductor in electrical engagement with a first end of the fuse when the fuse is assembled into the fuse holder and a second fuse holder conductor in electrical engagement with a second end of the fuse when the fuse is assembled into the fuse holder, said first fuse holder conductor electrically connected to one of the line side connector and the load side connector when the fuse holder is in an operating position, said second fuse holder conductor electrically connected to the other of the line side connector and the load side connector when the fuse holder is in an operating position; and a cam pivotably supported by said body about a second axis, spaced from said first axis, said cam connected to said switch, said cam having a cam feature in intimate engagement with a fuse carrier feature to block the advancement of the fuse carrier into the body when the cam is in a first angular orientation relative to said body, the cam having a second angular orientation relative to said body, different than the first angular orientation, the second angular orientation permitting the advancement of the fuse carrier into the body.

17. The fuse holder as in claim 16, wherein said cam urges said switch from said first position to said second position as said fuse carrier is removed from said fuse holder.

18. The fuse holder as in claim 16:

wherein said fuse carrier defines a longitudinal axis; and wherein said fuse carrier is separable from said body in a direction along the longitudinal axis of said fuse carrier.

19. The fuse holder as in claim 16:

Wherein said cam feature comprises a void; and wherein said cam further defines a protuberance engaging the switch.

20. The fuse holder as in claim 16,

Wherein said cam feature comprises a void and

Wherein said fuse carrier feature comprises a protrusion.

* * * * *